United States Patent [19]

Maeda et al.

[11] Patent Number: 5,055,877

[45] Date of Patent: Oct. 8, 1991

[54] COPYING APPARATUS WITH MOVEABLE SCREEN AND METHOD

[75] Inventors: Yasutaka Maeda, Ikoma; Natsuko Tanaka, Nara; Katsuhiro Nagayama; Hideyuki Nishimura, both of Yamatokoriyama, all of Japan

[73] Assignee: Sharp Kabushiki Kaisha, Osaka, Japan

[21] Appl. No.: 460,586

[22] Filed: Jan. 3, 1990

[30] Foreign Application Priority Data

Jan. 9, 1989 [JP] Japan ..... 1-2603
Feb. 14, 1989 [JP] Japan ..... 1-34508

[51] Int. Cl.[5] ..... G03G 21/00

[52] U.S. Cl. ..... 355/214; 355/71; 355/246; 355/326

[58] Field of Search ..... 355/239, 71, 69, 214, 355/326, 246, 265, 208

[56] References Cited

U.S. PATENT DOCUMENTS

Re. 32,330 1/1987 Miyakawa et al. ..... 355/228 X
3,580,671 5/1971 Lavander ..... 355/239
4,066,351 1/1978 Kidd ..... 355/214
4,128,329 12/1978 Kawano ..... 355/246
4,697,920 10/1987 Palm et al. ..... 355/327
4,821,076 4/1989 Toyoshi et al. .
4,901,104 2/1990 Sakakibara ..... 355/138 X

FOREIGN PATENT DOCUMENTS 0037731 10/1981 European Pat. Off. ..... 355/208
47-5740 3/1972 Japan .

OTHER PUBLICATIONS

Japanese Abstract, vol. 9, No. 265 (P-399) (1988) 10/23/85.
Japanese Document A 60113229 (Toshiba).
Japanese Abstract, vol. 8, No. 282 (P-323) (1719) 12/22/84.
Japanese Document A 59148069 (Matsushita Denki Sangyo) 8/24/84.

*Primary Examiner*—A. T. Grimley
*Assistant Examiner*—P. Stanzione

[57] ABSTRACT

A copying apparatus in which a screen for improving gradation characteristics of a copied image can be retractably projected into an optical path, including a device for setting, when the screen is placed in the optical path and retracted from the optical path, a developing voltage to a first value and a second value, respectively such that the first value is lower than the second value.

20 Claims, 10 Drawing Sheets

COPYING APPARATUS WITH MOVEABLE SCREEN AND METHOD

BACKGROUND OF THE INVENTION

The present invention generally relates to copying apparatuses and more particularly, to a copying apparatus which is capable of controlling density of a copied image by retractably projecting into an optical path a screen for improving gradation characteristics of the copied image.

Generally, in electrophotographic copying apparatuses, it is difficult to reproduce an image of medium density in the same manner as other image forming apparatuses such as a printer, etc Conventionally, in the copying apparatuses, it is known that if a screen having transparent and opaque portions formed by a pattern of lines, meshes or dots is placed in an optical path, gradation characteristics of a copied image are remarkably improved.

However, if the screen is placed in the optical path, the opaque portions of the screen are disposed in the optical path, thereby resulting in substantial reduction of quantity of light of an exposure lamp for attenuating surface voltage of a photosensitive member.

Meanwhile, FIG. 1 shows one example of a screen having a pattern of lines In FIG. 2, the curves (i) and (ii) show gradation characteristics in the case where the screen of FIG. 1 is disposed and is not disposed adjacent to the photosensitive member, respectively. It is seen from FIG. 2 that gradation characteristics are remarkably improved by using the screen when an original document has low density. However, if an original document having characters or drawings, for example, an original document having character A shown in FIG. 3*a* is copied by using the screen of FIG. 1, the copied image is undesirably formed with slits as shown in FIG. 3*c*. On the contrary, if the original document of FIG. 3*a* is copied without using the screen of FIG. 1, a proper image is obtained as shown in FIG. 3*b*. Therefore, it is desirable that the screen can be retractably projected into the optical path selectively according to original documents.

However, if the screen is merely retractably projected into the optical path, the following serious problem arises. Namely, generally, the known copying apparatuses have a control function to maintain quantity of light of the exposure lamp at a fixed level at all times in response to variations of external input voltage. Since quantity of light of the exposure lamp changes greatly at the time of projection of the screen into or retraction of the screen from the optical path as described above, control range of quantity of light of the exposure lamp should be made quite wide. Furthermore, such a screen mechanism is widely employed in color copying apparatuses in which gradation characteristics are especially vital. In the color copying apparatuses, since R (red), G (green) and B (blue) filters for separating colors of the original document, quantity of light of the exposure lamp is further reduced by these filters in addition to the screen, such an inconvenience is incurred that an excellent image cannot be obtained in some photosensitive members, for example, an OPC (organic photoconductor) type photosensitive member having low sensitivity generally.

Meanwhile, when the known copying apparatuses are changed over to a gradation display mode in which the screen is used and a standard mode in which the screen is not used, copying conditions change, thus offering the following problem. Namely, in order to obtain a proper or desired density of the copied image according to density of the original document, the known copying apparatuses are provided with an adjusting dial or an adjusting key switch for adjusting density of the copied image. However, since quantity of exposure light changes greatly between cases of presence and absence of the screen as described above, it is difficult to adjust density of the copied image to a proper or desired level in both the gradation display mode and the standard mode by using an identical adjustment range.

SUMMARY OF THE INVENTION

Accordingly, an essential object of the present invention is to provide a copying apparatus in which an excellent copied image can be obtained at all times without increasing control range of quantity of light of an exposure lamp regardless of whether or not a screen for improving gradation characteristics of the copied image is projected into or retracted from an optical path.

Another important object of the present invention is to provide a copying apparatus in which density of the copied image can be adjusted over a wide range in both a gradation display mode utilizing the screen and a standard mode not utilizing the screen and can be adjusted with identical operational feeling regardless of whether the copying apparatus is in the gradation display mode or the standard mode.

In order to accomplish these objects of the present invention, there is provided a copying apparatus embodying the present invention in which a screen for improving gradation characteristics of a copied image is retractably projected into an optical path an improvement includes means responsive to the placement of the screen, so that when the screen is placed into the optical path and retracted out of the optical path, a development voltage is set to a first value and a second value respectively, such that the first value is lower than the second value.

Generally, copy density ID requiring the screen is 1.0 or less, for example, the ID of human face is 0.5 or less. Thus, in the case where the screen has been projected into the optical path, about 1.0 will suffice for the maximum ID. Thus, in order to set the ID at 1.0 in a full color copying apparatus, a developing voltage of about 200 V may be employed. Therefore, if the developing voltage is set at 200 V at the time when a blue filter is used, input voltage of the exposure lamp is in a practical range of about 75 to 85 V. Namely, when the screen is retracted from the optical path, the developing voltage is set at 300 V. Meanwhile, when the screen is projected into the optical path, the developing voltage is lowered to 200 V. Thus, since an adjustment width of the input voltage of the exposure lamp is restricted to a practical range, control range of quantity of light of the exposure lamp is not required to be increased. Furthermore, an excellent image can be obtained.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by reference numerals throughout several views of the accompanying drawings.

DETAILED DESCRIPTION OF THE INVENTION

Figure 1:
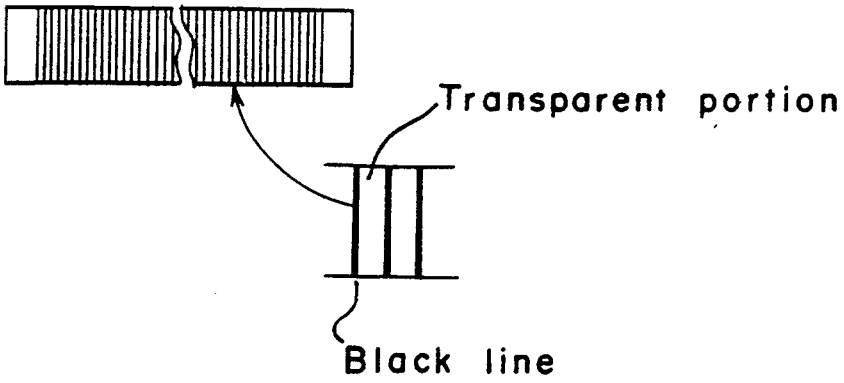
Fig. 1 PRIOR ART
FIG. 1 is a schematic view of a prior art screen.
Figure 2:
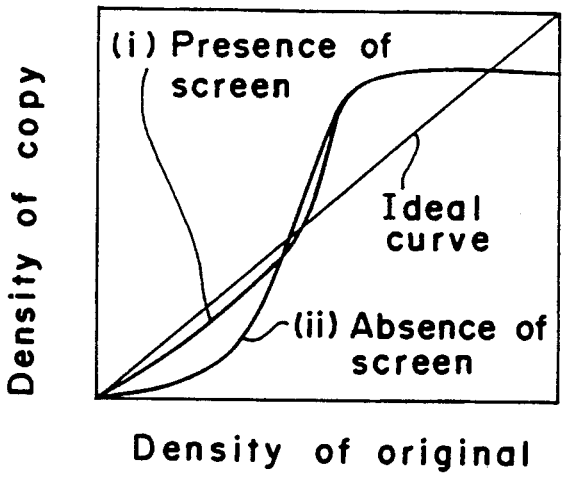
Fig. 2 PRIOR ART
FIG. 2 is a graph showing $\gamma$ curve at the time of presence and absence of the screen of FIG. 1.
Figure 3A:
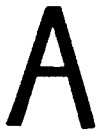
FIG. 3*a* is a view showing an original document having character A.
Figure 3B:
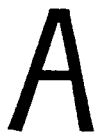
FIG. 3*b* is a view showing a copied image of the original document of FIG. 3*a* obtained without using the screen of FIG. 1.
Figure 3C:
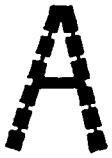
FIG. 3*c* is a view showing a copied image of the original document of FIG. 3*a* obtained by using the screen of FIG. 1.
Figure 4:
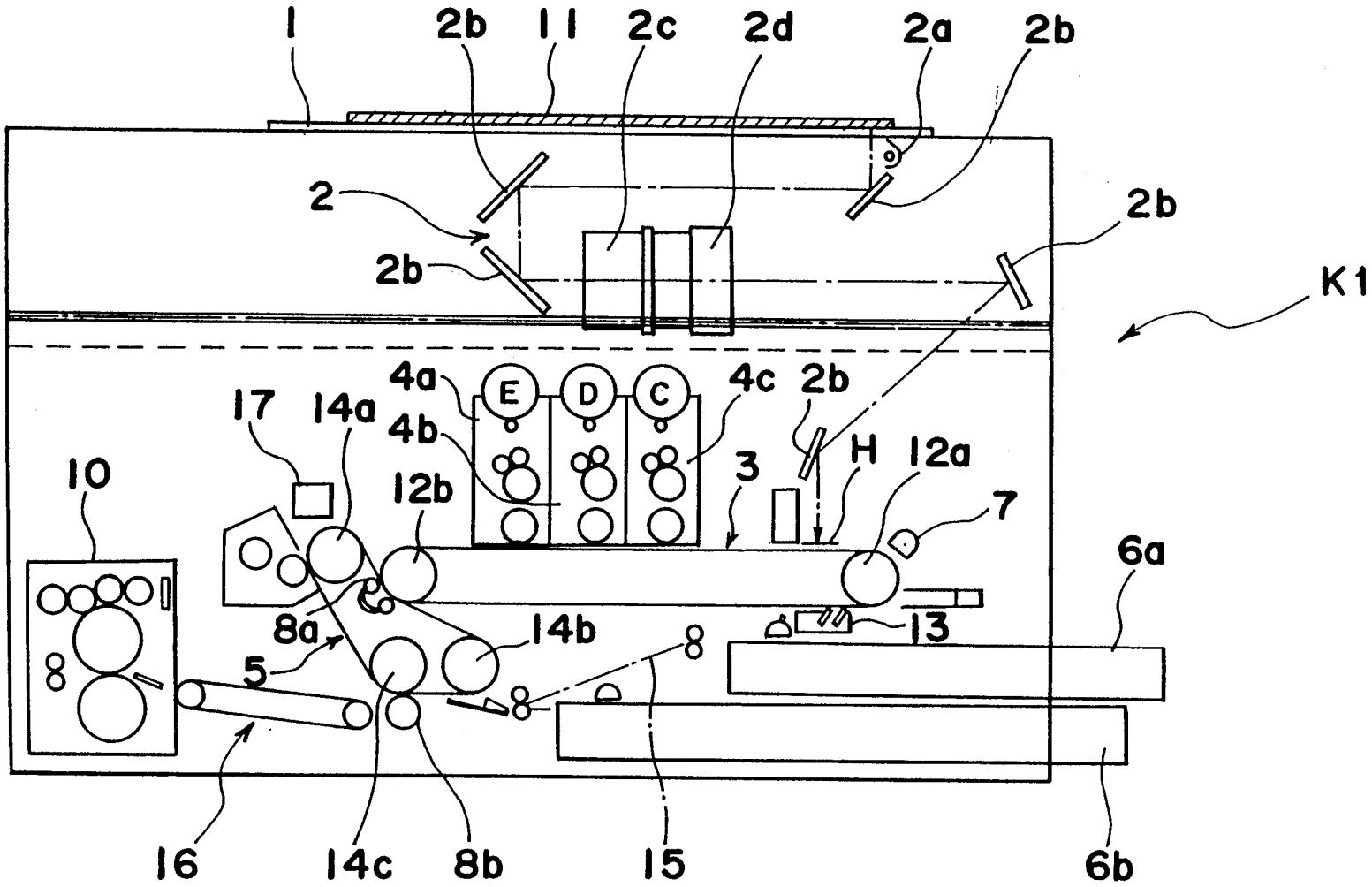
FIG. 4 is a schematic view showing construction of a full color copying apparatus according to a first embodiment of the present invention.

Referring now to the drawings, there is shown in FIG. 4, a full color copying apparatus K1 according to a first embodiment of the present invention. The copying apparatus K1 includes a transparent original platform 1, an exposure optical system 2, a sheetlike photosensitive member 3, an yellow developing tank 4*a* containing developer of yellow, a magenta developing tank 4*b* containing developer of magenta, a cyan developing tank 4*c* containing developer of cyan, a sheetlike intermediate transfer member 5, first and second paper feeding cassettes 6*a* and 6*b* containing copy paper sheets of different sizes, respectively, a corona charger 7, a pair of first transfer rollers 8*a*, a second transfer roller 8*b* and a fixing device 10.

The exposure optical system 2 includes an exposure lamp 2*a* acting as a light source for irradiating light onto an original document 11 placed on the original platform 1, a plurality of reflecting mirrors 2*b*, an image forming lens 2*c* disposed on an optical path and a color separation filter 2*d* having three color filters of primary colors, i.e. red, green and blue, respectively. Reflected light from the original document 11 is guided onto the photosensitive member 3, for example, as shown by the one-dot chain line by the reflecting mirrors 2*b*.

The photosensitive member 3 is rotatably driven by first and second rollers 12*a* and 12*b*. The developing tanks 4*a* to 4*c* are provided adjacent to an upper central portion of the photosensitive member 3 so as to be held out of contact with the photosensitive member 3. The corona charger 7, etc. are provided at one side of the photosensitive member 3 adjacent to the first roller 12*a*. In the vicinity of the first roller 12*a*, a cleaning mechanism 13 for removing residual toner on the photosensitive member 3 is provided at the underside of the photosensitive member 3.

The intermediate transfer member 5 is rotatably driven by three rollers 14*a*, 14*b* and 14*c* and is provided at the other side of the photosensitive member 3 adjacent to the second roller 12*b*. At the second roller 12*b*, the photosensitive member 3 and a side face of the intermediate transfer member 5 are brought into pressing contact with each other. At a location of pressing contact between the photosensitive member 3 and the intermediate transfer member 5, a pair of the first transfer rollers 8*a* are provided at a side of the intermediate transfer member 5 remote from the photosensitive member 3 so as to transfer to the intermediate transfer member 5, the toner image formed on the surface of the photosensitive member 3. In addition, the second transfer roller 8*b* is provided at the underside of the intermediate transfer member 5 so as to further transfer to a recording medium 15 such as a copy paper sheet, the toner image transferred onto the intermediate transfer member 5.

Hereinbelow, operation of the copying apparatus K1 of the above described arrangement is described briefly. Initially, the exposure lamp 2*a* irradiates light onto the original document 11 on the original platform 1 so as to scan the original document 11 several times. The optical image is guided, via the image forming lens 2*c*, to the color separation filter 2*d* by the reflecting mirrors 2*b* so as to be separated into optical images having the color components of the color separation filter 2*d*, respectively. The optical images having the respective color components, which have been transmitted through the color filters of the color separation filter 2*d* by several scanning, are sequentially subjected to exposure on the photosensitive member 3 charged uniformly by the corona charger 7. Then, latent images formed sequentially for the respective color components are, respectively, developed into visible toner images by the developers of yellow, magenta and cyan in the developing tanks 4*a*, 4*b* and 4*c*, respectively. It is to be noted that yellow, magenta and cyan of the developers of the developing tanks 4*a* to 4*c* are complementary colors of the primary colors, i.e. blue, green and red of the color filters of the color separation filter 2*d*, respectively. Thereafter, the visible images are sequentially transferred onto the intermediate transfer member 5 by the first transfer rollers 8*a*. In this way, the toner images of the respective color components are overlapped on the intermediate transfer member 5 and thus, a complete color toner image is formed.

The recording medium 15 is taken out of either one of the first and second paper feeding cassettes 6*a* and 6*b* so as to be brought into close contact with the lower face of the intermediate transfer member 5 such that the color toner image is transferred onto the recording medium 15 by the second transfer roller 8b. Subsequently, the recording medium 15 is separated from the intermediate transfer member 5 and is guided, through a transport passage 16, to the fixing device 10 in which the color image transferred onto the recording medium 15 is fixed.

Figure 5:
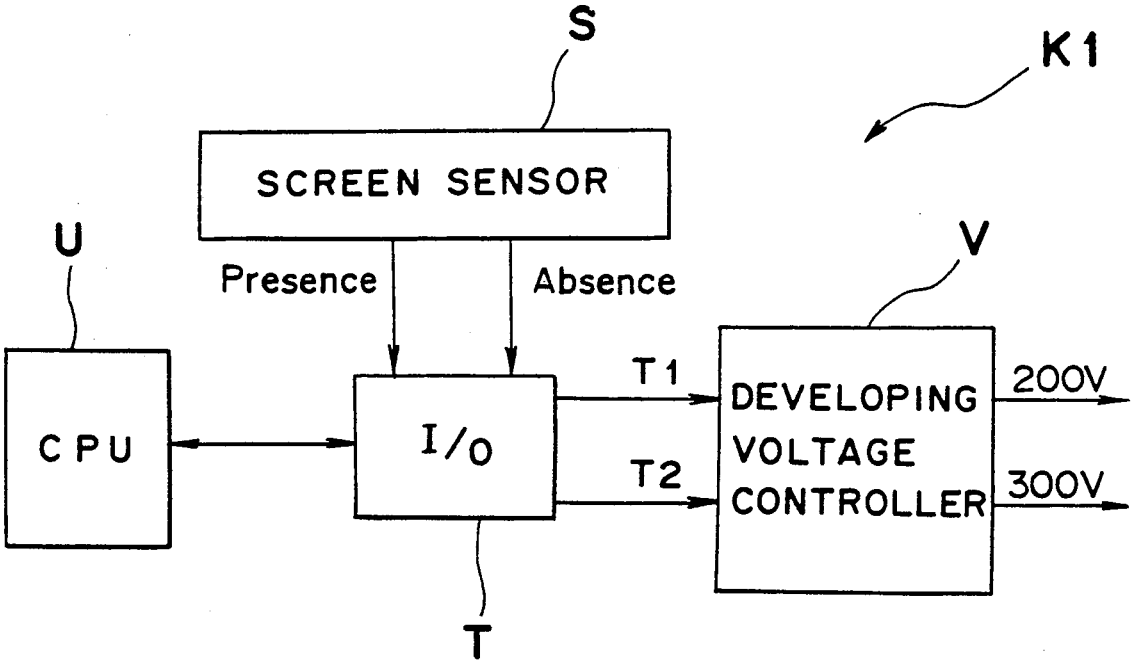
FIG. 5 is a control circuit diagram of the copying apparatus of FIG. 4.

FIG. 5 shows a control circuit employed in the copying apparatus K1. The control circuit is arranged to change developing voltage on the basis of presence and absence of a screen H (FIG. 4) for improving gradation characteristics of a copied image. The control circuit includes a screen sensor S for detecting whether or not the screen H is projected into the optical path. Presence and absence of the screen H may be detected by using ON and OFF signals of a switch for detecting the screen H. The detection signals of the screen sensor S are outputted to a CPU U via an I/O port T. On the basis of the detection signals of the screen sensor S, the CPU U judges whether or not the screen H is projected into the optical path. When the screen H is projected into the optical path, the CPU U outputs a signal T1 to a developing voltage controller V through the I/O port T. Meanwhile, when the screen H is not projected into the optical path, the CPU U outputs a signal T2 to the developing voltage controller V via the I/O port T. In response to the signals T1 and T2, the developing voltage controller V controls the developing voltage to 200 V and 300 V, respectively. In order to change the developing voltage, it is possible to adopt one of a method in which surface voltage of the photosensitive member is changed and a method in which developing bias is changed. The same effects can be achieved by the two methods.

Figure 6:
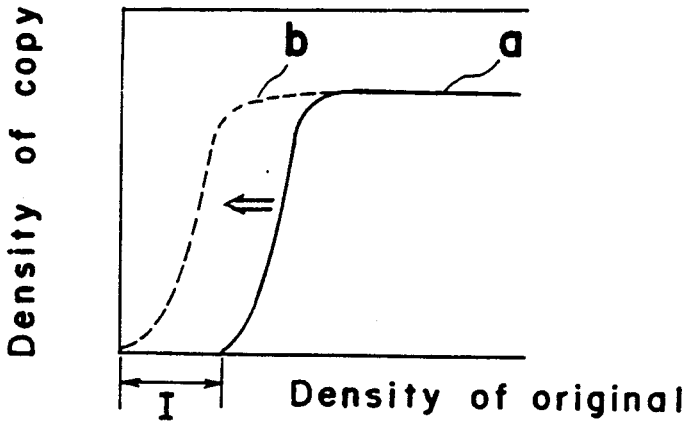
FIG. 6 is a graph showing shift of 7 curve in the copying apparatus of FIG. 4.

In the full color copying apparatus K1, setting of an adjusting dial for adjusting quantity of light of the exposure lamp 2a is performed such that a fine copy can be obtained. To this end, quantity of light of the exposure lamp 2a can be changed by the operator so as to be applicable to various kinds of commercially available original documents such that the ordinary $\gamma$ curve a (curve showing relation between density of the original document and density of the copy) of the obtained copy is shifted to the $\gamma$ curve b as shown in FIG. 6. Hence, since possible gradation range of the copied image is set in a region I where a large amount of density of the original document is distributed. Namely, the adjusting dial can be set such that $\gamma$ curve is raised from the brightest location of the region I. Experiments performed for obtaining better gradation characteristics of the copied image have disclosed that the best image is obtained by the following conditions (1) to (4).

(1) Screen: 100–133 lines/inch
(2) Opaque portion of screen: 20–40%
(3) Distance between screen and photosensitive member: 0.7–2.0 mm
(4) Photosensitive member: OPC (Organic photoconductor)

Figure 7:
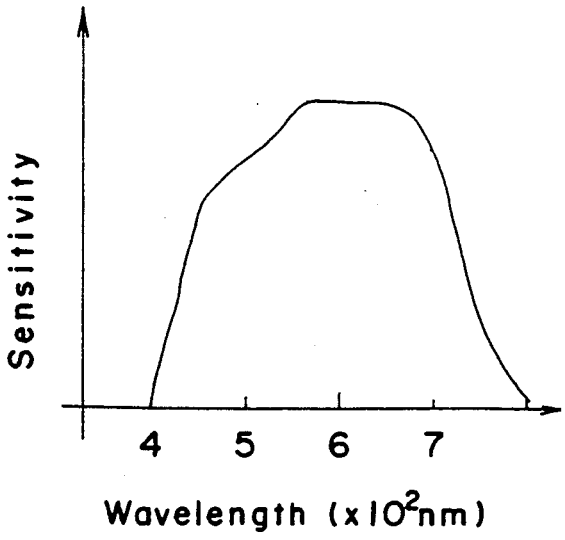
FIG. 7 is a graph showing spectral characteristics of a photosensitive member employed in the copying apparatus of FIG. 4.
Figure 8:
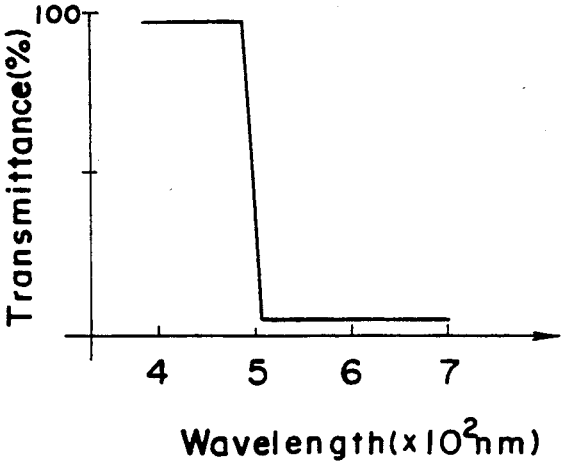
FIG. 8 is a graph showing relation between wavelength and transmittance obtained by using a blue filter in the copying apparatus of FIG. 4.
Figure 9:
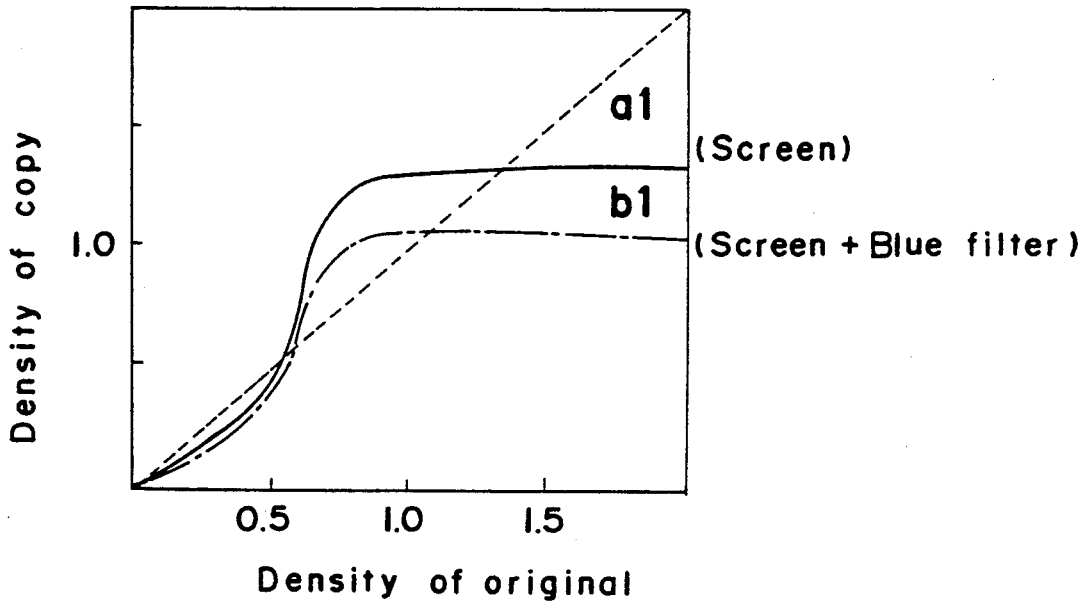
FIG. 9 is a graph showing $\gamma$ curve obtained by using a screen and the blue filter of FIG. 8 in the copying apparatus of FIG. 4.

At this time, if developing voltage is set to −300 V by subtracting a developing bias of −100 V from a surface voltage of −400 V, i.e. −400 V−(−100 V) and the screen H has been retracted from the optical path, input voltage of the exposure lamp 2a ranges from 60 to 70 V by using the blue color filter in the case where an adjustment range is obtained in which $\gamma$ curve rises at a density of 0.1 to 0.4. As shown in FIG. 7, spectral sensitivity of the photosensitive member (OPC) is low at wavelengths of 400 to 500 nm and the largest quantity of light is necessary for a process utilizing the blue color filter shown in FIG. 8. In the case where the screen H is placed in the optical path in this process utilizing the blue color filter, the $\gamma$ curve al in FIG. 9 becomes quite proximate to an ideal curve. However, if the same adjustment range of density as described above should be obtained, input voltage of the exposure lamp 2a ranges from about 85 to 95 V. This input voltage is impracticably large in view of service life and power consumption of the exposure lamp 2a and temperature rise of the copying apparatus K1.

At this time, the original document to be copied by using the screen H requires gradation characteristics greatly and therefore, should scarcely have characters, etc. Namely, the original document may consist of photographs in many cases. Generally, in the original document having photographs, copy density ID will usually assume 1.0 or less, for example, copy density ID of a photograph of a human face is usually 0.5 or less. Namely, in the case of use of the screen H, about 1.0 will suffice for the maximum copy density ID.

In order to set the copy density ID to 1.0 in the above process, about 200 V suffices for developing voltage. If the same adjustment range of density as described above is obtained at a developing voltage of 200 V in experiments, input voltage of the exposure lamp 2a is in a practical range of 75 to 85 V by using the blue filter as shown by the curve b1 in FIG. 9. Namely, by setting developing voltage to 200 V and 300 V when the screen H is projected into and retracted from the optical path, respectively, the screen H can be used in the full color copying apparatus in which the OPC having low sensitivity generally is employed as the photosensitive member. Furthermore, it becomes possible to obtain a full color copy having scant defects and excellent gradation characteristics.

Figure 10:
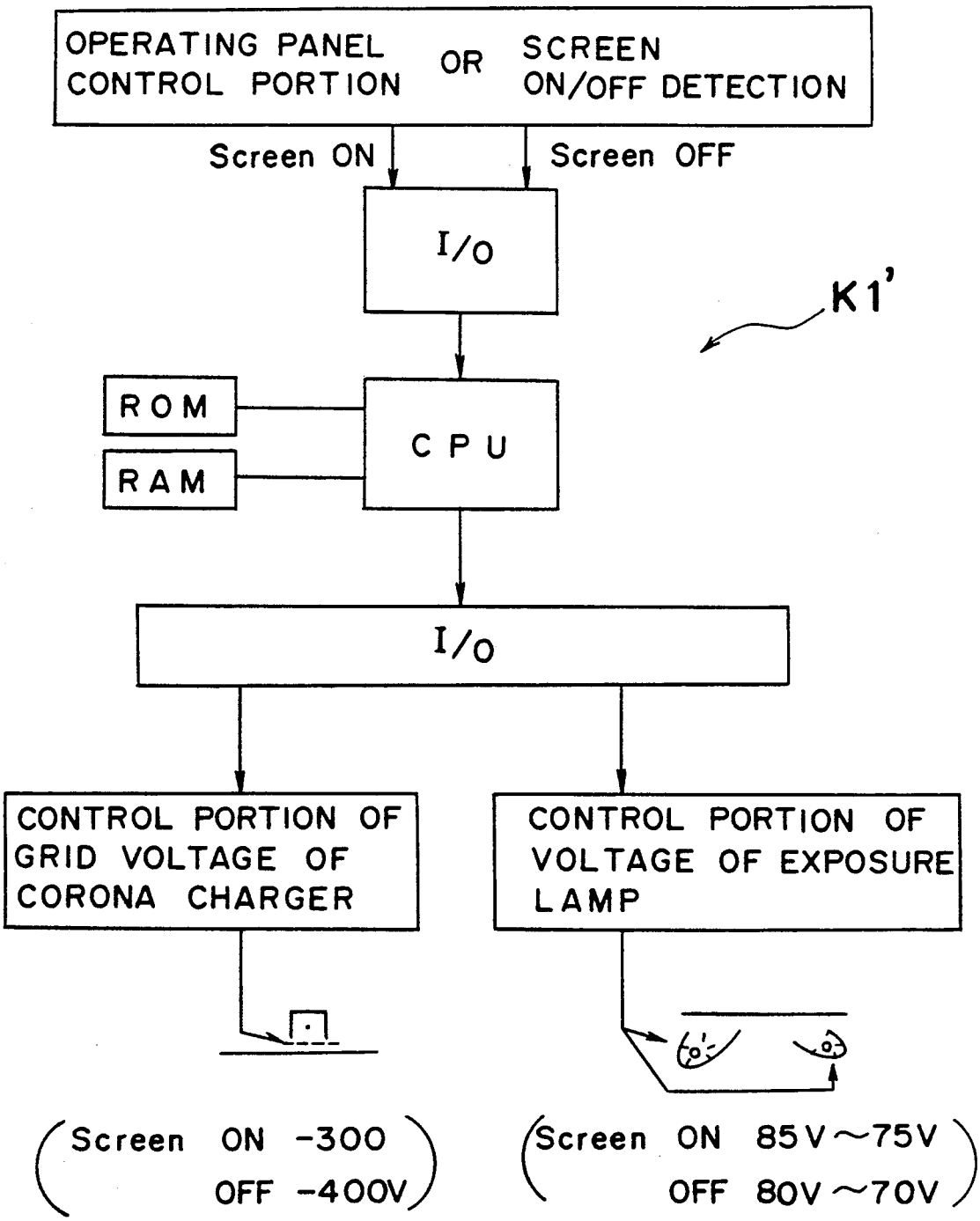
FIG. 10 is another control circuit diagram of a modification of the copying apparatus of FIG. 4.

FIG. 10 shows another control circuit employed in a full color copying apparatus K1' which is a modification of the copying apparatus K1. In the control circuit of FIG. 5, developing voltage at the developing device is changed in response to insertion of the screen H into the optical path and retraction of the screen H from the optical path. On the other hand, in the control circuit of FIG. 10, voltage of the exposure lamp 2a or grid voltage of the corona charger 7 is controlled in response to turning on and off of the screen H, i.e., projection of the screen H into the optical path and retraction of the screen H from the optical path. Namely, when the screen H has been turned on, drive voltage for driving the exposure lamp 2a is set by a CPU through an I/O port to be higher than that obtained at the time of turning off of the screen H. For example, the exposure lamp is driven at 80 to 70 V when the screen H has been turned off. Meanwhile, the exposure lamp 2a is driven at 85 to 75 V when the screen H has been turned on.

Meanwhile, the same effects as those obtained by control of developing voltage of the developing device can be obtained by setting grid voltage of a grid of the corona charger 7 to −300 V and −400 V in response to turning on and off of the screen H, respectively. At this time, either one of drive voltage applied to the exposure lamp 2a and grid voltage applied to the grid of the corona charger 7 is controlled in response to turning on and off of the screen H. However, it can also be so arranged that both of the drive voltage and grid voltage are controlled simultaneously in response to turning on and off of the screen H. Furthermore, it can also be so arranged that the drive voltage and grid voltage in addition to the developing voltage are controlled simultaneously in response to turning on and off of the screen H.

As is clear from the foregoing description, in the copying apparatus according to the first embodiment of the present invention, the means for setting developing voltage is provided such that developing voltage obtained at the time when the screen is disposed in the optical path is set lower than that obtained at the time when the screen is retracted from the optical path. Accordingly, it becomes possible to obtain an excellent copied image without the need for increasing control range of quantity of light of the exposure lamp regardless of whether or not the screen is projected into or retracted from the optical path.

Figure 11:
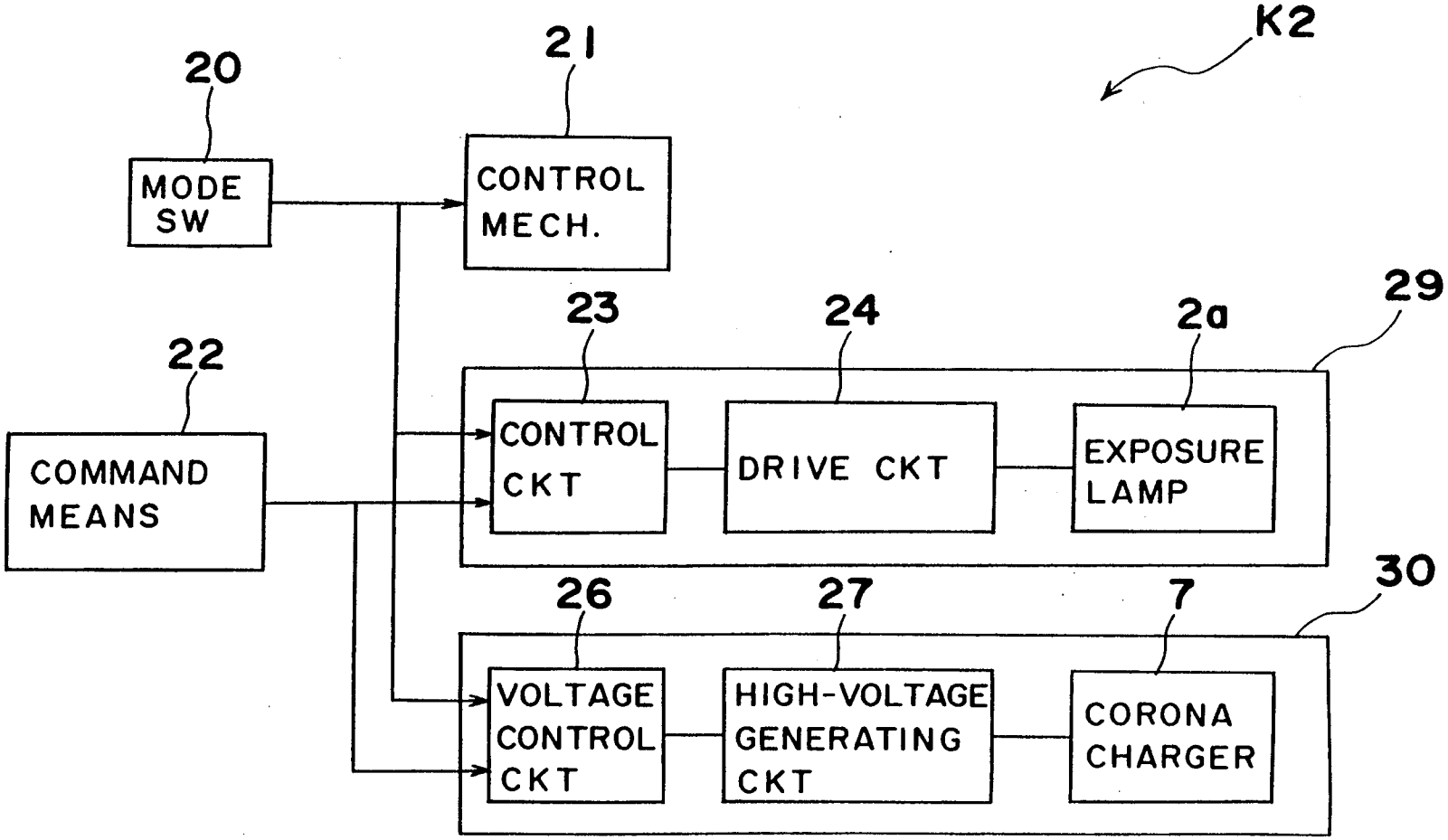
FIG. 11 is a block diagram of a full color copying apparatus according to a second embodiment of the present invention.

FIG. 11 shows a full color copying apparatus K2 according to a second embodiment of the present invention. Since mechanical construction of the copying apparatus K2 is substantially the same as that of the copying apparatus K1 shown in FIG. 4, description thereof is abbreviated for the sake of brevity. The copying apparatus K2 includes a mode switch 20 and a control mechanism 21. The mode switch 20 is provided for effecting changeover between a gradation display mode utilizing the screen H and a standard mode not utilizing the screen H. The control mechanism 21 is provided for inserting the screen H into the optical path towards the photosensitive member 3 in the gradation display mode. The copying apparatus K2 further includes a command means 22 for issuing, through its manipulation by the operator, a command of adjusting density of an image, an exposure control means 29 for controlling quantity of exposure and a development control means 30 for controlling amount of development. The command means 22 is formed by, for example, a key switch or an adjusting dial. Meanwhile, the exposure control means 29 controls quantity of exposure through control of quantity of light of the exposure lamp 2*a*.

The exposure control means 29 includes a control circuit 23 for controlling electric power supplied to the exposure lamp 2*a*, a drive circuit 24 for driving the exposure lamp 2*a* in response to an output signal from the control circuit 23. In the standard mode, the control circuit 23 controls, in accordance with a command from the command means 22, electric power supplied to the exposure lamp 2*a*.

The development control means 30 includes a voltage control circuit 26, a high-voltage generating circuit 27 and the corona charger 7 and controls surface voltage of the photosensitive member 3 by voltage applied to the corona charger 7 for charging the photosensitive member 3. Voltage applied to the corona charger 7 by the high-voltage generating circuit 27 is controlled by a signal from the voltage control circuit 26. In the gradation display mode, the voltage control means 26 controls, in response to the command from the command means 22, voltage applied to the corona charger 7.

Figure 12:
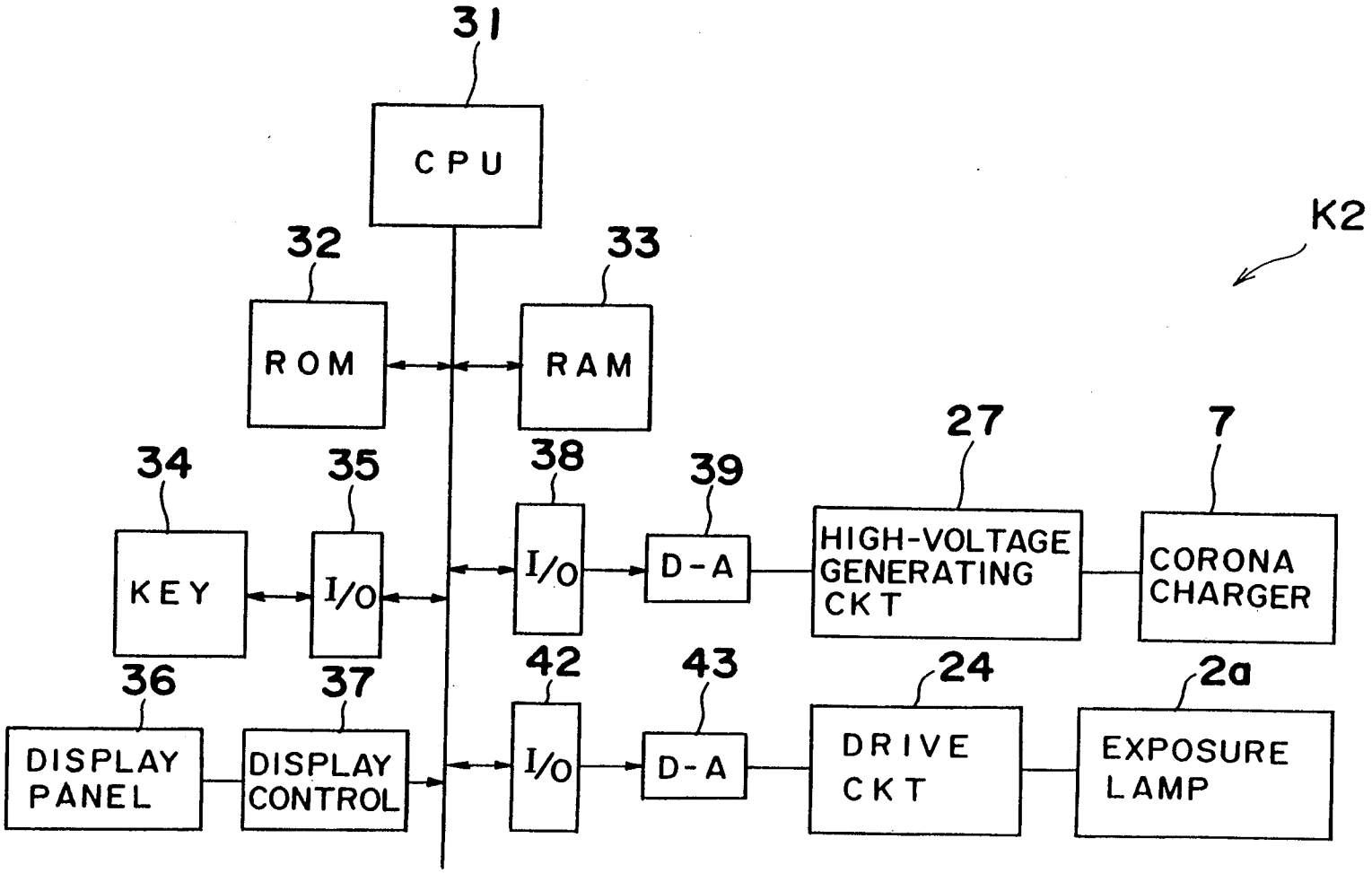
FIG. 12 is a block diagram of a control portion of the copying apparatus of FIG. 11.
Figure 16:
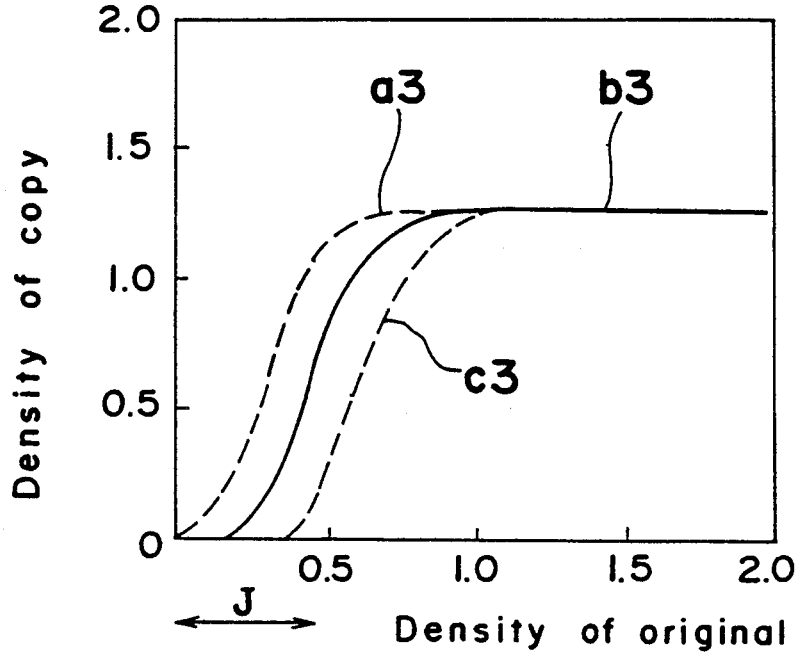
FIG. 16 is a graph showing change of $\gamma$ curve effected by exposure control in the copying apparatus of FIG. 11.

Meanwhile, in the copying apparatus K2 having mechanical construction substantially identical with that of the copying apparatus K1 shown in FIG. 4 as described earlier, it is necessary that $\gamma$ curve of a copied image showing relation between density of an original document and density of a copy, which is obtained by changing quantity of exposure on the photosensitive member, can be adjusted such that various kinds of original documents can be copied by the copying apparatus K2. If quantity of exposure on the photosensitive member 3 is changed, an oblique portion of $\gamma$ curve is shifted as shown in FIG. 16. This oblique portion, i.e. an area manifesting gradation is adjusted by the operator so as to fall in the region J in which a major portion of density of the original document is distributed In the copying apparatus K2, density of the copied image is adjusted in the mode utilizing the screen H, i.e. in the gradation display mode by changing developing voltage with input voltage of the exposure lamp 2*a* being held within a practical range. Hereinbelow, one concrete example of control of the copying apparatus K2 is described. FIG. 12 shows a control portion of the copying apparatus K2. In FIG. 12, a CPU 31 controls a whole of the control portion and executes a program written preliminarily in a ROM 32. For execution of this program, a RAM 33 stores various flags and data for setting process conditions. A key switch 34 includes a switch for effecting changeover between the gradation display mode and the standard mode, a key switch for adjusting density of a whole of an image and key switches for densities of colors of yellow, magenta and cyan, respectively. The CPU 31 reads contents of operation of the key switch 34 through an I/O port 35. A display panel 36 includes display members for displaying a current setting state of the modes and a command state for adjusting density of the image, respectively and is controlled by a display control circuit 37. The display control circuit 37 includes a display memory such that display is performed by the display panel 36 when the CPU 31 has written display data in the display memory.

In response to a control signal, the high-voltage generating circuit 27 supplies a predetermined voltage to the corona charger 7. When the CPU 31 has set data in an I/O port 38, a D/A converter 39 converts the data into an analog signal so as to supply the analog signal to the high-voltage generating circuit 27. In response to a lamp control signal, the drive circuit 24 drives the exposure lamp 2*a* When the CPU 31 has outputted the lamp control signal through an I/O port 42, a D/A converter 43 converts the lamp control data into an analog signal so as to supply the analog signal to the drive circuit 24.

Figures 13A, 13B:
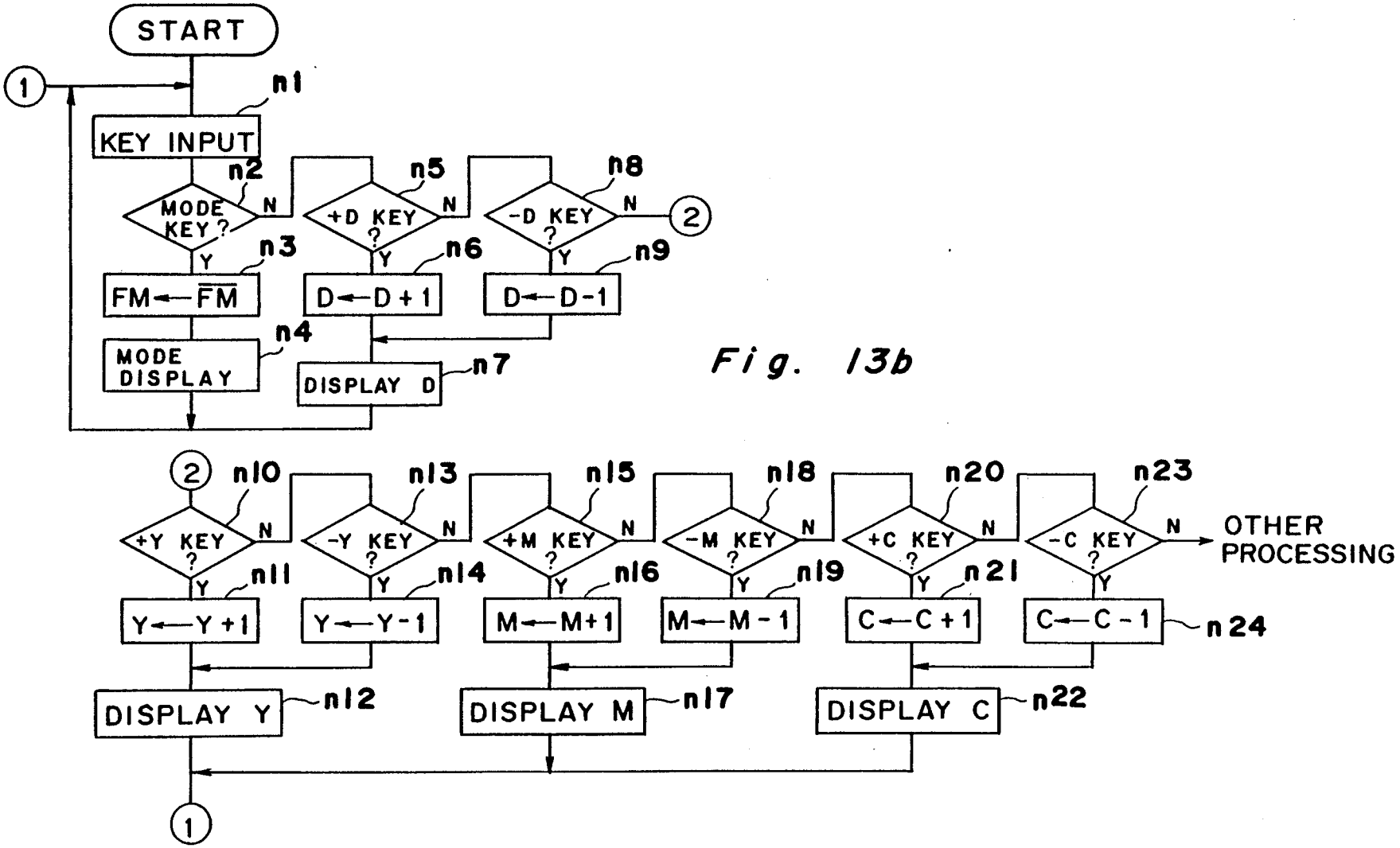
FIGS. 13*a* and 13*b* and FIG. 14 are flow charts showing processing sequences of the copying apparatus of FIG. 11.

FIGS. 13*a* and 13*b* show processing sequence of the CPU 31 performed in the case where the operator issues a command for adjusting density of the image. Initially, at step n1, key inputs are performed such that processings corresponding to the actuated keys are performed. If it is found at step n2 that a mode key has been actuated, a state of a flag FM for storing the mode is inverted at step n3 and this state is displayed at step n4. At this time, if the flag FM is in a set state, the copying apparatus K2 is in the gradation display mode. Meanwhile, if the flag FM is in a reset state, the copying apparatus K2 is in the standard mode. On the contrary, in the case of "NO" at step n2, namely, if it is found at step n5 that a +D key has been actuated, a value of D is increased at step n6 and the value is displayed at step n7. In the case of "NO" at step n5, namely, if it is found at step n8 that a −D key has been actuated, a value of D is reduced at step n9 and the value is displayed at step n7. It is to be noted that a value of D represents density of a whole of the image, which is raised and lowered upon actuation of the +D key and the −D key, respectively.

In the case of "NO" at step n8, namely, if it is found at step n10 that a +Y key has been actuated, a value of Y is increased at step n11 and the value is displayed at step n12. On the other hand, in the case of "NO" at step n10, namely, if it is found at step n13 that a −Y key has been actuated, a value of Y is reduced at step n14 and the value is displayed at step n12. It should be noted that a value of Y denotes an adjustment value of density of yellow and density of yellow is raised and lowered upon actuation of the +Y key and the −Y key, respectively. Likewise, density of magenta is raised and lowered upon actuation of a +M key and −M key, respectively at steps n15 to n19, while density of cyan is raised and lowered upon actuation of a +C key and a −C key, respectively at steps n20 to n24. In this way, the mode is designated and a command for adjusting density of the image is issued. Meanwhile, each of the data D, Y, M and C used for the command for adjusting density of the image is expressed in several steps and is increased or reduced within a range not exceeding its upper and lower limits at steps n6, n9, n11, n14, n16, n19, n21 and n24.

Figure 14:
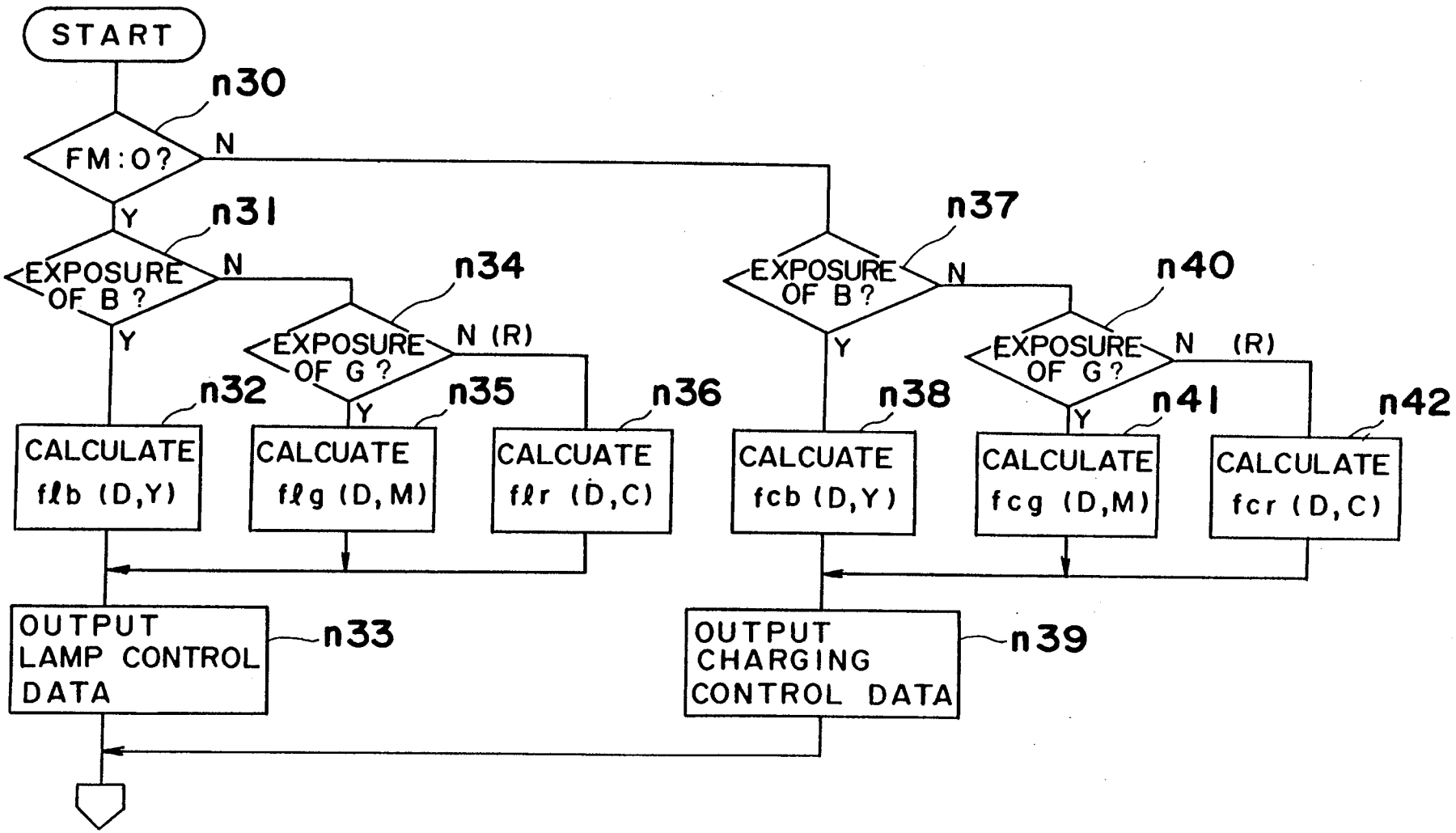

FIG. 14 shows processing sequence of the CPU 31 for setting copying process conditions in accordance with various preset requirements. As shown in FIG. 14, if exposure of blue is performed when the flag FM is in the reset state, namely, the copying apparatus K2 is in the standard mode, lamp control data are obtained by performing predetermined calculation of a function flb(D, Y) of lamp output by using the values of D and Y as parameters and are outputted at steps n30, n31, n32 and n33. If exposure of green is performed in the standard mode, lamp control data are obtained by performing predetermined calculation of a function flg(D, M) of lamp output by using the values of D and M as parameters and are outputted at steps n34, n35 and n33. Similarly, if exposure of red is performed in the standard mode, lamp control data are obtained by performing predetermined calculation of a function flr(D, C) of lamp output by using the values of D and C as parameters and are outputted at steps n34, n36 and n33.

On the other hand, if exposure of blue is performed when the flag FM is in the set state, namely, when the copying apparatus K2 is in the gradation display mode, charging control data are obtained by performing predetermined calculation of a function fcb(D, Y) of surface voltage by using the values of D and Y as parameters and are outputted at steps n37, n38 and n39. If exposure of green is performed in the gradation display mode, charging control data are obtained by performing predetermined calculation of a function fcg(D, M) of surface voltage by using the values of D and M as parameters and are outputted at steps n40, n41 and n39. Likewise, if exposure of red is performed in the gradation display mode, charging control data are obtained by performing predetermined calculation of a function fcr(D, C) by using the values of D and C as parameters and are outputted at steps n40, n42 and n39.

As described above, in the standard mode in which the screen H is not used, quantity of light of the exposure lamp 2*a* is controlled on the basis of the data D indicating adjustment of density of a whole of the image and the data Y, M and C indicating adjustment of densities of the colors of blue, green and red, respectively in order to control density of the image. Meanwhile, in the gradation display mode in which the screen H is used, voltage supplied to the corona charger 7 is controlled on the basis of the data D and the data Y, M and C in order to control density of the image.

Figure 15:
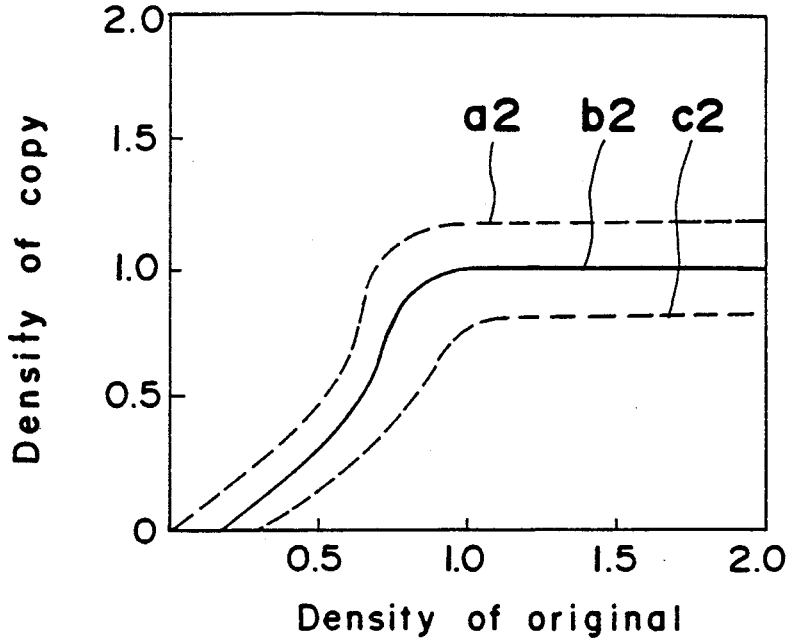
FIG. 15 is a graph showing change of $\gamma$ curve in a gradation display mode of the copying apparatus of FIG. 11.

When the values of D, Y, M and C are of intermediate level in the gradation display mode, quantity of light of the exposure lamp 2*a* is fixed such that $\gamma$ curve rises at a point of 0.2 to 0.3. When surface voltage of the photosensitive member 3 is changed in accordance with the values of D, Y, M and C, $\gamma$ curve changes as shown in FIG. 15. In FIG. 15, the $\gamma$ curve b2 represents characteristics obtained when an intermediate value of a range of change of density of the image is adopted. The $\gamma$ curve a2 represents characteristics obtained when surface voltage of the photosensitive member 3 is so set as to be higher by 50 V than that of the $\gamma$ curve b2, while the $\gamma$ curve c2 represents characteristics obtained when surface voltage of the photosensitive member 3 is so set as to be lower by 50 V than that of the $\gamma$ curve b2. As shown in FIG. 15, saturation density changes slightly but density of the image can be controlled in the same manner as in FIG. 16 showing control of density of the image through change of quantity of exposure. In FIG. 16, the $\gamma$ curve b3 represents characteristics obtained when the a reference voltage is applied to the exposure lamp 2*a*, the $\gamma$ curve a3 represents characteristics obtained when voltage applied to the exposure lamp 2*a* is so set as to be lower by 5 V than the reference voltage of the $\gamma$ curve b3 and the $\gamma$ curve c3 represents characteristics obtained when voltage applied to the exposure lamp 2*a* is so set as to be higher by 5 V than the reference voltage of the $\gamma$ curve b3.

As is seen from the foregoing, in the copying apparatus according to the second embodiment of the present invention, density of the image is adjusted on the basis of quantity of exposure in a known manner in the standard mode in which the screen for improving gradation characteristics of the copied image is not used. Meanwhile, in the gradation display mode in which the screen is used, density of the image is adjusted by controlling difference between surface voltage of the photosensitive member and developing bias. Therefore, in accordance with the second embodiment of the present invention, it is not necessary to greatly change input voltage of the exposure lamp and similar adjustment range of density of the image can be obtained regardless of the standard mode and the gradation display mode.

Furthermore, in accordance with the second embodiment of the present invention, since density of the image can be adjusted by using an identical command means for issuing a command of adjusting density of the image, two key switches or adjusting dials are not required to be provided for the standard mode and the gradation display mode, respectively and thus, it becomes possible to adjust density of the image in both of the standard mode and the gradation display mode with identical operational feeling.

In addition, in accordance with the second embodiment of the present invention, selective use of the screen can be performed even in a color copying apparatus employing a photosensitive member having relatively low sensitivity.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus comprising:

a screen for improving gradation characteristics of a copied image, the screen being moveable so as to be projected into and out of an optical path; and means, responsive to placement of said screen into the optical path and out of the optical path, for setting a developing voltage to a first value and a second value, respectively, such that the first value is lower than the second value.

2. A copying apparatus as claimed in claim 1, wherein said means for setting includes a sensor for detecting said screen, an I/O port connected to said sensor, a CPU and a controller connected to said CPU through said I/O port.

3. The apparatus of claim 1 wherein said developing voltage has a value which is equal to a value of a surface voltage minus a value of a development bias voltage.

4. The apparatus of claim 3 wherein said means for setting sets the value of the development voltage by varying the value of surface voltage.

5. The apparatus of claim 3 wherein said means for setting sets the value of the development voltage by changing the development bias voltage value.

6. The apparatus of claim 3 further including a corona charger for applying surface voltage to a photosensitive member.

7. The apparatus of claim 6 wherein the photosensitive member is a belt.

8. The apparatus of claim 3 further including development means for applying the development bias voltage to a photosensitive member.

9. The apparatus of claim 8 wherein the photosensitive member is a belt.

10. A copy apparatus comprising:

a photosensitive member;

a screen for improving gradation characteristics of a copied image;

command means for adjusting a density of a whole of the copied image or a density of a specific color of the copied image;

said apparatus having a gradation display mode in which exposure is performed by placing said screen in an optical path confronting said photosensitive member and a standard mode in which exposure is performed without using said screen;

exposure control means for controlling quantity of exposure on the basis of a command of said command means in the standard mode; and development control means for controlling a difference between a surface voltage and a developing bias on the basis of a command in the gradation display mode.

11. The copying apparatus as claimed in claim 10, wherein said exposure control means includes a control circuit for controlling electric power supplied to an exposure lamp and a drive circuit for driving said exposure lamp in response to a signal from said control circuit;

said development control means including a voltage control circuit for controlling a voltage applied to a corona charger and voltage generating means for generating the voltage in response to a signal from said voltage control circuit.

12. A copying apparatus comprising:

a photosensitive member;

a screen for improving gradation characteristics of a copied image;

command means for adjusting the total density of a copied image or a specific color of the copied image;

means for locating said screen in and out of an optical path; and exposure control means for controlling the quantity of exposure of the copied image based on a command of said command means, by controlling an amount of voltage supplied to an exposure lamp; the voltage supplied to said exposure lamp being a first value when said screen is in the optical path and a second value which is higher than the first value when said screen is out of the optical path.

13. The apparatus of claim 12 wherein the first value of voltage supplied to the exposure lamp is about 85 to 75 V.

14. The apparatus of claim 13 wherein the second value of voltage supplied to the exposure lamp is about 80 to 70 V.

15. The apparatus of claim 12 further including a corona charger for charging the photosensitive member; and means for changing a grid voltage of the photosensitive member, the amount of voltage change being dependent on the placement of the screen in or out of the optical path.

16. A copying apparatus comprising:

a photosensitive member;

means for applying a surface charge to said photosensitive member;

a screen for placement into and out of an optical path directed to the photosensitive member;

command means for adjusting the total density of a copied image or specific color of the copied image; and control means for controlling the amount of surface charge applied by said means for applying said surface charge, the amount of surface charge depending on whether said screen is in or out of said optical path.

17. The apparatus of claim 16 wherein said means for applying a surface charge is a corona charger.

18. The apparatus of claim 17 wherein the surface charge is controlled by varying a grid voltage of the corona charger.

19. The apparatus of claim 18 wherein the grid voltage is a first value when the screen is in the optical path and a second value when the screen is out of the optical path.

20. A method of improving gradation characteristics of a copied image produced by a copying machine by changing the development voltage comprising the steps of:

(a) moving a screen in and out of an optical path, the optical path being between a copied image and a photosensitive member;

(b) changing the development voltage to a first and second value respectively with the first value being lower than the second value; and (c) wherein the development voltage is equal to a value of a surface voltage minus a value of a development bias voltage and step (b) is performed by changing at least one of the surface voltage value or the development bias voltage value.

* * * * *